United States Patent [19]

Denda

[11] Patent Number: 4,650,393

[45] Date of Patent: Mar. 17, 1987

[54] MACHINE FOR EXCAVATING WORK

[75] Inventor: Rinta Denda, Sakaki, Japan

[73] Assignee: Takeuchiseisakusho Co., Ltd., Naganoken, Japan

[21] Appl. No.: 722,872

[22] Filed: Apr. 12, 1985

[30] Foreign Application Priority Data

Apr. 18, 1984 [JP] Japan ..... 59-57673[U]

[51] Int. Cl.[4] ..... E02F 3/32

[52] U.S. Cl. ..... 414/694; 414/706

[58] Field of Search ..... 414/694, 685, 687, 706

[56] References Cited

U.S. PATENT DOCUMENTS 3,149,737 9/1964 Guinot ..... 414/694

3,283,928 11/1966 Bosredon ..... 414/694

3,313,431 4/1967 Kelly ..... 414/694

3,515,298 6/1970 Guinot ..... 414/694

3,669,286 6/1972 Gauchet ..... 414/694

*Primary Examiner*—Joseph E. Valenza

*Assistant Examiner*—D. Glenn Dayoan

*Attorney, Agent, or Firm*—Jordan and Hamburg

[57] ABSTRACT

A machine for excavating work such as an oil-pressure shovel comprising a boom, an arm, and bucket. The turning shaft for an arm turning device provided on the arm is made capable of turning in the vertical plane including the boom, and this turning shaft is equipped with a turn control device effective for keeping the turning shaft vertical irrespective of the vertical movement of the boom.

3 Claims, 7 Drawing Figures

MACHINE FOR EXCAVATING WORK

BRIEF SUMMARY OF THE INVENTION

The present invention relates to a machine for excavating work, more particularly, to a machine for excavating work such as an oil-pressure shovel which comprises a boom, an arm, and a bucket, and has a turning shaft of an arm turning device at the tip of the boom for turning in a vertical plane including the boom. The machine is equipped with a turn control device for the turning shaft which keeps the turning shaft almost vertical irrespective of the vertical movement of the boom so that the bucket may always move in a vertical plane as the boom makes a vertical movement and may always move in a horizontal plane as the arm makes a turn about its turning shaft.

One machine for excavating work such as a small-sized oil-pressure shovel mainly for use in digging a trench, has a structure (cf. FIG. 4) in which a boom turning device is provided in the front middle of a turn base 200 of the machine proper to extend out a boom 202*a*, thereby allowing the boom to turn right and left about a point 204*a* for a short distance from the turn base of the machine proper.

The machine performance for digging a trench depends mainly on the distance from the machine proper at which the arm and bucket can be operated in a vertical plane, i.e., the distance between the center of the turn base of the machine proper and the center line of the excavating section composed of the arm and bucket.

In order to improve the performance for digging a trench, i.e., to increase the above-specified intercentral distance, it may be considered effective to increase the distance between the center of the turn base of the machine proper and the boom turning device and to increase the angle of lateral turning of the boom turning device.

However, the distance between the boom turning device and the turn base of the machine proper cannot be made so long because the former is to be provided on the other. In addition, that a distance between them is found too long is impractical since it does not match with the machine proper to thereby cause instability of the system and to reduce the capacity of the machine.

For the above reasons, some modifications of machine were made; in an example (cf. FIG. 5) an arm turning device was provided at the tip of a boom 202*b* and in another example (FIG. 6), a boom bending device 208*c* was provided at an intermediate position on a boom 202*c* so as to allow the boom 202*c* to simply bend.

With these modifications, a distance between the center of the boom turning device of the machine proper and the arm turning device or the boom bending device can be made long. It follows that the intercentral distance may be made long so as to satisfy one of the requirements imposed on the machine for trench excavating work.

In these conventional modifications, in addition to the turn base of the machine proper, a second turning section is provided at a halfway point to the excavation working section so that the bending section, when viewed from over it, makes extended L shapes. This provision of the second turning section is effective since, for example in the case of trench excavating work, the excavation working section may be operated along the trench line with the machine proper being placed not on the trench line but at some constant distance from the trench line.

For such a trench excavating work, the system setting is usually made so that the trench excavating work may be conducted with efficiency in the range from the state where the bucket at the end of the excavation working section is in contact with the ground surface to the limit of arm operation.

In other words, the system is set in such a way that the second turning shaft of the second intermediate turning section assumes an almost vertical position at the initial stage of excavating work where the arm is extended with the bucket in contact with the ground surface just before the boom is to be put into vertical movement.

Some unfavorable conditions will appear as the excavating work proceeds with the boom going down: The second turning shaft gets inclined from the vertical positioning in the plane of vertical movement of the boom and at the same time the arm gets inclined with respect to its own axis. Thus, the excavating work proceeds with the bucket at the tip of the arm inclined, resulting in formation of irregular trench bottom face, deviation of the corner angle from 90°, and scooping of the lower part of side wall. Moreover, since the plane of turning of the arm is inclined with respect to the vertical direction, an excavating work with turning of the arm results in unnecessary scrape of the trench wall.

A horizontal turning of the machine proper results in another unfavorable phenomenon: The accompanying horizontal turning of the base and arm usually occurs with the second turning shaft more or less inclined from the vertical direction, and therefore the arm is necessarily turned about the inclined second turning shaft. It follows that, when the arm, with the bucket full of excavated soil, is turned to transfer the soil into a delivery means, the bucket will get more and more inclined until a considerable amount of the soil has been dropped out before being received in the delivery means. A similar unfavorable sequence will also occur during an elevation of the boom.

A mechanism for solving the above problem of unfavorable phenomena was proposed (cf. FIG. 7) which adopts provision of two horizontal turning shafts, one in the middle and the other at the tip of the boom 202*d*. However, this mechanism, with the second and third turning shafts 210*d* and 212*d* provided on the boom 202*d*, cannot help becoming complicated and is incapable of increasing the span (=intercentral distance) between the machine proper and the working line.

The present inventor has devoted himself to the solution of the above-described problems involved in the conventional systems. As a result, he has achieved the aim by providing a second turning shaft at a prescribed position, preferably at the tip, of the boom in coupled turning with the machine proper, extending the arm via this second turning shaft, and controlling this second turning shaft to be kept positioned vertical irrespective of the positioning of the boom.

It is, therefore, an object of the present invention to offer a machine for excavating work capable of excavating a trench, etc. precisely and efficiently at a position considerably away from the machine proper.

A further object of the present invention is to offer a machine for excavating work which, having only a second turning shaft added on the boom, is capable of excavating a trench, etc. precisely and efficiently.

Another object of the present invention is to offer a machine for excavating work which, when applied to a work for excavating a trench, etc., is capable of keeping the blades of the bucket at the tip of the arm horizontal so as to form the section of the trench corner in a precise L shape.

Still another object of the present invention is to offer a machine for excavating work which, while the arm is being turned, is capable of holding the arm vertical, preventing the bucket from going aslant against the trench wall.

Yet another object of the present invention is to offer a machine for excavating work which, while the arm is being turned in a horizontal plane, is capable of preventing the plane of arm turning from getting inclined with resulting drop of soil from the bucket.

DETAILED DESCRIPTION OF THE INVENTION

A preferred embodiment is described in detail below by reference to the accompanying drawings.

Figure 1:
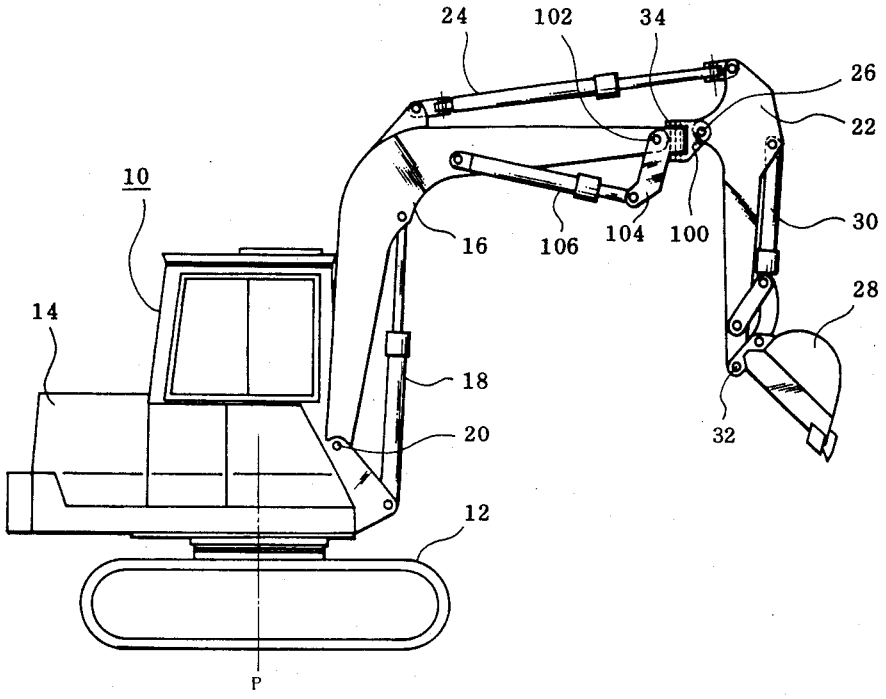
FIG. 1 is a side view of a machine for excavating work according to the present invention.

FIG. 1 shows a side view of an excavator such as a power shovel. A machine proper 10 is shown schematically. A turn base 14 is provided on a travelling device 12 so as to be capable of turning. A cylinder 18 allows a boom 16 to turn about a boom turning shaft 20.

A cylinder 24 allows an arm 22 to turn in a vertical plane about a turning shaft 26 provided horizontally. A cylinder 30 allows a bucket 28 to turn about a turning shaft 32 provided horizontally at the tip of the arm 22.

Figure 2:
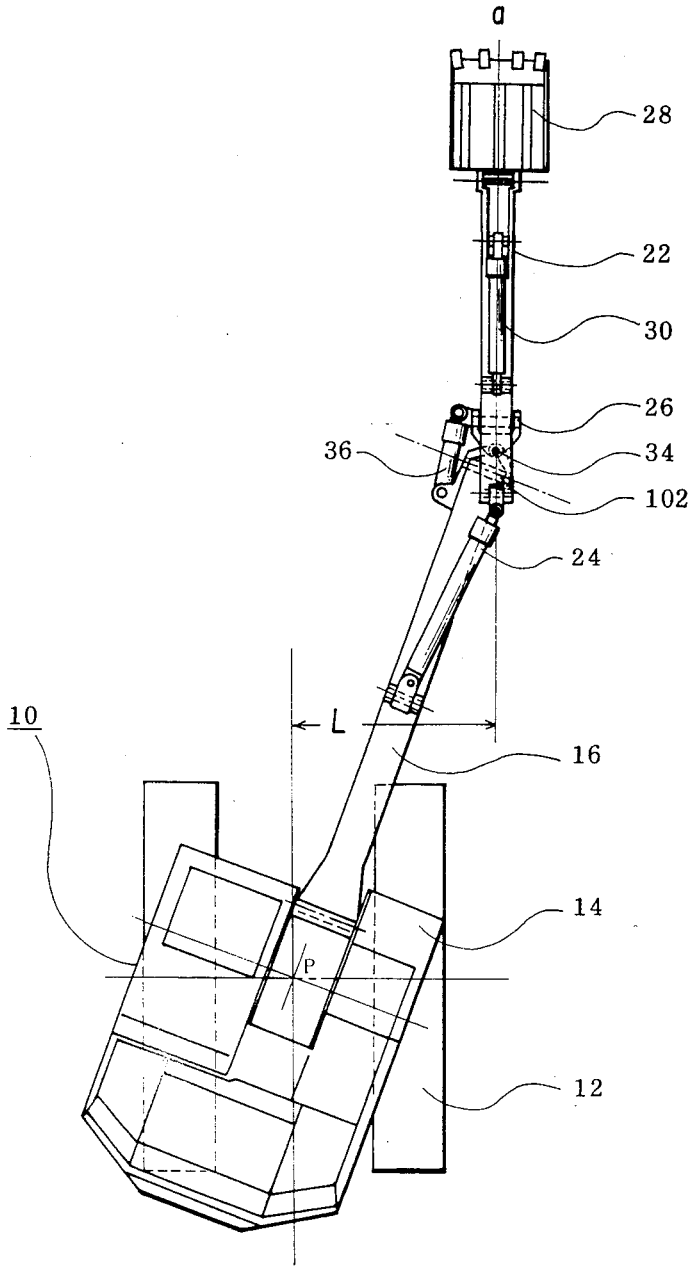
FIG. 2 is a plan illustrative of the state of a trench excavating work by the machine for excavating work according to the present invention.

A second turning shaft 34 serves to turn the arm 22 horizontally; a cylinder 36 shown in FIG. 2 allows the arm 22 to turn about the second turning shaft 34.

A bearing piece 100 for holding the second turning shaft 34 is provided at an end of a lever arm 104 capable of turning about a horizontal pin 102, and a cylinder 106 is provided which connects the other end of the lever arm 104 with the boom 16.

Both the cylinders 18 and 106 are coupled with each other so that the second turning shaft 34 is kept vertical, i.e., parallel to the first turning shaft P of the turn base 14 of the machine proper 10, irrespective of the positioning of the boom 16.

Figure 3:
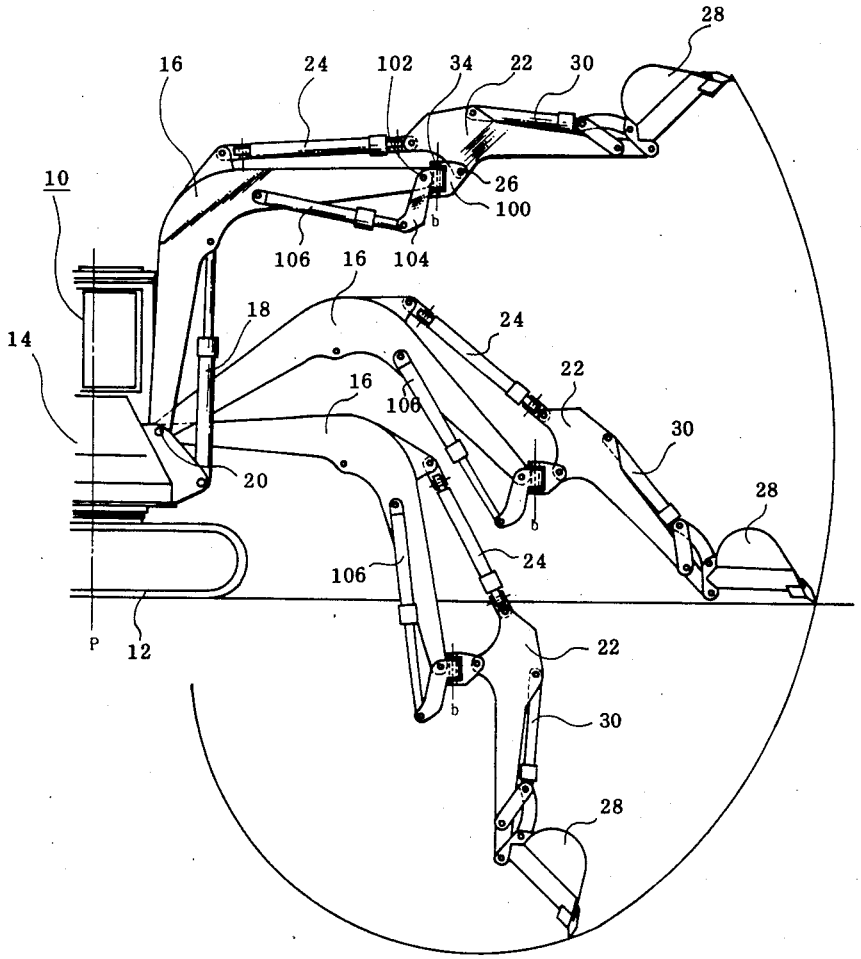
FIG. 3 is a plan illustrative of the operation of the machine for excavating work according to the present invention.
Figure 4:
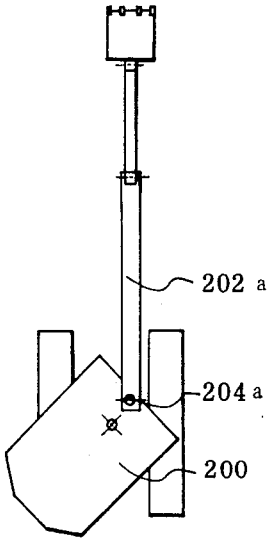
FIG. 4 PRIOR ART
FIG. 4 is a schematic plan of a conventional system having a second turning shaft provided at the root of the boom.
Figure 5:
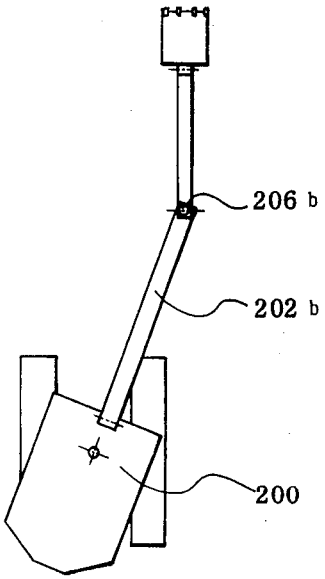
FIG. 5 PRIOR ART
FIG. 5 is a schematic plan of a conventional system having a second turning shaft provided at the tip of the boom.
Figure 6:
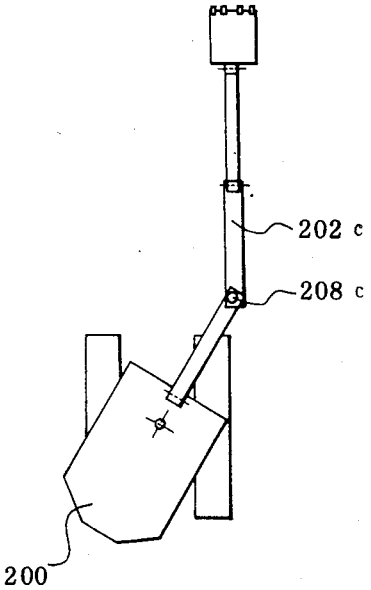
FIG. 6 PRIOR ART
FIG. 6 is a schematic plan of a conventional system having a second turning shaft provided in the middle of the boom.
Figure 7:
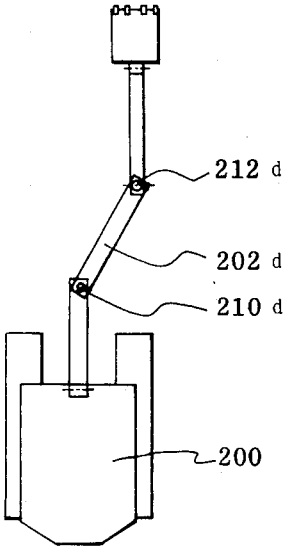
FIG. 7 PRIOR ART
FIG. 7 is a schematic plan of a conventional system having horizontal turning shafts each in the middle and at the tip of the boom.

With such a structure of the machine according to the present invention, the system operates as illustrated in FIG. 3; an operation of the cylinder 18 causes the boom 16 to turn about the boom turning shaft 20 and at the same time the cylinder 106 operates to cause the lever arm 104 to turn, so that the center line b of the second turning shaft 34 is kept vertical, i.e., parallel to the first turning shaft P.

The positioning of the system for digging a trench is effected by, as shown in FIG. 2, setting the machine proper 10 at a distance from the trench line a, turning the turn base 14 to put the tip of the boom 16 on the trench line a, and finally bringing the arm 22 and the bucket 28 onto the trench line a.

Since the second turning shaft 34 is provided at the tip of the boom 16, the intercentral distance L between the trench line a and the first turning shaft P may be made considerably long as seen from FIG. 2, which satisfies one of favorable conditions for digging a trench.

The structure that the second turning shaft 34 is kept vertical leads to an advantage that both the arm 22 and the bucket 28 are operated in the vertical plane over the trench line a, i.e., that the jobs of excavation, delivery, and removal are carried out with both the arm 22 and the bucket 28 kept vertical to the ground surface. It follows that, since the blade of the bucket 28 is kept flat with respect to the ground surface, the bottom face of a trench may be made horizontal and smooth, the corner section is made to be at a good right angle, and that the bucket 28 will not go aslant on the side wall of trench, resulting in a vertical wall face.

Even when the arm 22 is turned about the second turning shaft 34, it turns in a horizontal plane so that the bucket 28 will not be inclined with no drop of soil or sand.

As described above, a simple modification that the second turning shaft 34 of the conventional machine is made rotatable as well as controllable to be always positioned vertical as the boom 16 makes a vertical movement, has resulted in provision of the machine with all the necessary abilities.

In the embodiment described above, the second turning shaft 34 is provided at the tip of the boom 16, but it may be provided at an intermediate position on the boom 16 if required by the condition on the intercentral distance.

The control of the second turning shaft 34 to be kept positioned vertical is effected not only by a computer-controlled power cylinder but also by a parallelogram link work which employs the first and second turning shaft P and 34 as the opposite arms in the parallelogram link.

The embodiment of the present invention has been described in detail with a suitable embodiment example. It goes without saying, of course, that the embodiment of the present invention is not limited to the example described above, but that many modifications are applicable within the scope not deviating from the spirit of the present invention.

I claim:

1. An excavator comprising:

a turn base having a first turning shaft, said turn base being rotatable about the first turning shaft, a boom including at one end a first horizontal shaft connected to the turn base so that the boom can be moved vertically, and at the other end a second horizontal shaft, an intermediate section including a lever arm rotationally connected to the boom by means of the second horizontal shaft, a bearing piece having a third horizontal shaft, and a second turning shaft oriented perpendicular to the second horizontal shaft and situated between the lever arm and the bearing piece, an arm rotationally connected to the bearing piece by means of the third horizontal shaft, said arm having a fourth horizontal shaft, a bucket rotationally connected to the arm by means of the fourth horizontal shaft, and a turn control device situated between the boom and the lever arm so that the second turning shaft is held vertically as the boom moves vertically, whereby the arm can be held vertically even if the arm is moved horizontally.

2. An excavator according to claim 1, further comprising first control means situated between the turn base and the boom to move the boom vertically, a second control means situated between the boom and the arm to move the arm vertically, a third control means situated between the arm and the bucket to move the bucket vertically, and a fourth control means situated between the boom and the bearing piece to move the bearing piece horizontally about the second turning shaft.

3. An excavator according to claim 2, further comprising a travelling device connected to the turn base for moving the excavator at a desired location.

* * * * *